US010368399B2

(12) United States Patent
Tucker et al.

(10) Patent No.: US 10,368,399 B2
(45) Date of Patent: Jul. 30, 2019

(54) E-VAPING DEVICE

(71) Applicant: Altria Client Services LLC, Richmond, VA (US)

(72) Inventors: Christopher S. Tucker, Midlothian, VA (US); Douglas A. Burton, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 185 days.

(21) Appl. No.: 14/736,059

(22) Filed: Jun. 10, 2015

(65) Prior Publication Data

US 2016/0366725 A1 Dec. 15, 2016

(51) Int. Cl.

| | |
|---|---|
| ***H05B 3/06*** | (2006.01) |
| ***H05B 3/12*** | (2006.01) |
| ***A24F 47/00*** | (2006.01) |

(52) U.S. Cl.

CPC ..... *H05B 3/12* (2013.01); *A24F 47/008* (2013.01); *H05B 3/06* (2013.01); *H05B 2203/014* (2013.01); *H05B 2203/021* (2013.01)

(58) Field of Classification Search

CPC ..... B29C 2045/7228; B29C 2045/725; B29C 45/4225; B29C 45/7207; B29C 49/06; B29C 49/6427; B29C 45/045; B29K 2067/00; B29K 2105/258; C08L 5/08; B29B 2911/14593; B29B 2911/14653; B29B 2911/14713

USPC ..... 131/330, 335, 361, 194, 195, 198.1; 413/298, 30, 326–326, 320, 321, 325, 413/120; 432/159; 436/175; 392/395

See application file for complete search history.

(56) References Cited

U.S. PATENT DOCUMENTS

| | | | | |
|---|---|---|---|---|
| 4,283,596 | A * | 8/1981 | Vidakovits | H01R 4/723 174/84 R |
| 4,384,404 | A * | 5/1983 | Watine | H01R 4/723 29/871 |
| 4,732,628 | A * | 3/1988 | Dienes | H02G 15/18 156/48 |
| 5,113,037 | A * | 5/1992 | King, Jr. | H01R 4/22 174/87 |
| 5,665,262 | A * | 9/1997 | Hajaligol | A24F 47/008 131/194 |
| 6,598,607 | B2 | 7/2003 | Adiga et al. | |
| 6,598,992 | B1 * | 7/2003 | Ames | A45D 42/00 362/138 |
| 9,491,974 | B2 * | 11/2016 | DePiano | A24F 47/008 |
| 9,497,994 | B2 * | 11/2016 | Liu | A61M 15/06 |

(Continued)

FOREIGN PATENT DOCUMENTS

| | | | |
|---|---|---|---|
| WO | WO-2014054035 | A1 | 4/2014 |
| WO | WO-2014139610 | A1 | 9/2014 |

(Continued)

*Primary Examiner* — Tu B Hoang
*Assistant Examiner* — Vy T Nguyen
(74) *Attorney, Agent, or Firm* — Harness, Dickey & Pierce, P.L.C.

(57) ABSTRACT

Example embodiments relate to a cartomizer including a housing, a fluid reservoir, configured to store an e-fluid, in the housing, a vaporizer configured to vaporize the e-fluid, the vaporizer including a heater having at least one end portion connected to an electrical lead wire, and a sleeve covering the connection between the end portion of the heater and the electrical lead wire.

16 Claims, 5 Drawing Sheets

(56) References Cited

U.S. PATENT DOCUMENTS

| | | | | |
|---|---|---|---|---|
| 2006/0180336 | A1* | 8/2006 | King, Jr. | H01R 4/22 174/87 |
| 2009/0283294 | A1* | 11/2009 | Bukovnik | H01B 3/40 174/102 R |
| 2011/0094523 | A1 | 4/2011 | Thorens et al. | |
| 2012/0318882 | A1 | 12/2012 | Abehasera | |
| 2013/0192615 | A1* | 8/2013 | Tucker | H01C 17/00 131/328 |
| 2013/0192619 | A1 | 8/2013 | Tucker et al. | |
| 2013/0192620 | A1* | 8/2013 | Tucker | H01C 17/00 131/329 |
| 2013/0213419 | A1 | 8/2013 | Tucker et al. | |
| 2014/0144453 | A1 | 5/2014 | Capuano et al. | |
| 2014/0150785 | A1* | 6/2014 | Malik | A61M 15/06 128/202.21 |
| 2014/0261408 | A1 | 9/2014 | DePiano et al. | |
| 2014/0261487 | A1 | 9/2014 | Chapman et al. | |
| 2014/0261489 | A1 | 9/2014 | Cadieux et al. | |
| 2014/0261493 | A1 | 9/2014 | Smith et al. | |
| 2014/0332022 | A1* | 11/2014 | Li | A24F 47/008 131/329 |
| 2015/0027471 | A1* | 1/2015 | Feldman | H05B 3/16 131/329 |
| 2016/0087502 | A1* | 3/2016 | Rumbaugh | H02K 3/44 310/71 |
| 2016/0374393 | A1* | 12/2016 | Chen | A24F 47/008 131/329 |

FOREIGN PATENT DOCUMENTS

| | | | |
|---|---|---|---|
| WO | WO-2014144678 | A2 | 9/2014 |
| WO | WO-2014150117 | A2 | 9/2014 |

* cited by examiner

E-VAPING DEVICE

BACKGROUND

Field

The present disclosure relates to an electronic vaping or e-vaping device operable to deliver liquid from a liquid supply source to a vaporizor.

Description of Related Art

An e-vaping device includes a heater element which vaporizes liquid material to produce a "vapor." The heater element includes a resistive heater coil, with a wick extending therethrough.

The e-vaping device includes a power supply, such as a battery, arranged in the device. More specifically, an electrical connection between an anode of the battery and the heating coil is established through a battery anode connection post, an anode post of a cartridge, and an electrical lead connecting the anode post with an electrical lead of the heating coil. Likewise, an electrical connection between a cathode of the battery and the heating coil is established through a cathode connection fixture, a cathode connector piece, and an electrical lead. The electrical leads and the heater coil leads are highly conductive and temperature resistant. The electrical leads may be connected to the heater coil leads by brazing or crimping. The electrical connections between the electrical leads and the heating coil leads are made from an electrically conductive material capable of being resistively heated, such as copper (Cu), copper alloys, porous ceramic materials coated with film resistive material, nickel-chromium alloy, and combination thereof. However, the liquid aerosol formulation and fluid in the device may react with the material, such as copper, causing discoloration of the gauze and wick near the heating coil.

SUMMARY

Example embodiments relate to a cartomizer including a housing, a fluid reservoir, configured to store an e-fluid, in the housing, a vaporizer configured to vaporize the e-fluid, the vaporizer including a heater having at least one end portion connected to an electrical lead wire, and a sleeve covering the connection between the end portion of the heater and the electrical lead wire.

In an example embodiment, the connection between end portion of the heater and the electrical lead wire may be formed by crimping.

In yet another example embodiment, the connection between end portion of the heater and the electrical lead wire may be formed by soldering.

In yet another example embodiment, the connection between end portion of the heater and the electrical lead wire may be formed by spot welding.

In an example embodiment, the housing may further include an outer tube; and an inner tube within the outer tube.

In yet another example embodiment, the inner tube may include a pair of opposing slots. The end portion of the heater may extend through one of the opposing slots.

In an example embodiment, the sleeve may be co-axial with the inner tube to cover a portion thereof.

In an example embodiment, the sleeve may be below the pair of opposing slots of the inner tube.

In an example embodiment, the vaporizer may include a wick, and the heater surrounds the wick such that heater heats liquid material to a temperature sufficient to vaporize the liquid and form a vapor. The sleeve may include an upper edge, in which the upper edge of the sleeve may be disposed near the wick without touching the wick.

In an example embodiment, the sleeve may partially close off an open space provided between the heater and the pair of opposing slots.

In an example embodiment, the vaporizer may include at least two electrical lead wires forming at least two connections between at least two end portions of the heater and the at least two electrical lead wires. The sleeve may cover the at least two connections between the at least two end portions of the heater and the at least two electrical lead wires.

In an example embodiment, the sleeve may substantially cover the electric lead wire extending from a power supply.

Example embodiments relate to an e-vaping device including a cartomizer, and a power supply configured to supply power to the heater. The cartomizer may include a housing, a fluid reservoir in the housing, the fluid reservoir configured to store an e-fluid, a vaporizer configured to vaporize the e-fluid, the vaporizer including a heater having at least one end portion connected to an electrical lead wire, and a sleeve covering the connection between the end portion of the heater and the electrical lead wire.

In an example embodiment, the power supply may be removably connected to the cartomizer via a connector.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
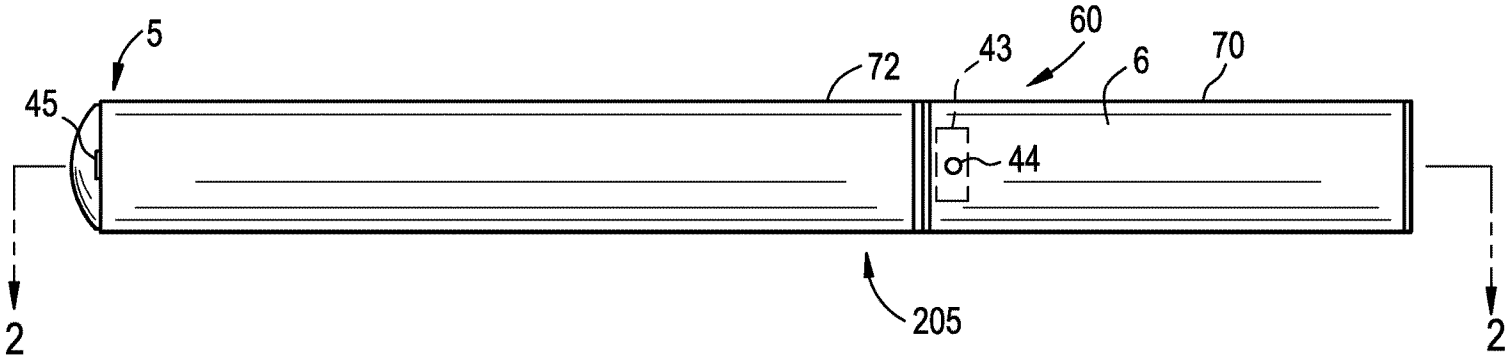
FIG. 1 is a planar view of an e-vaping device according to an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 2:
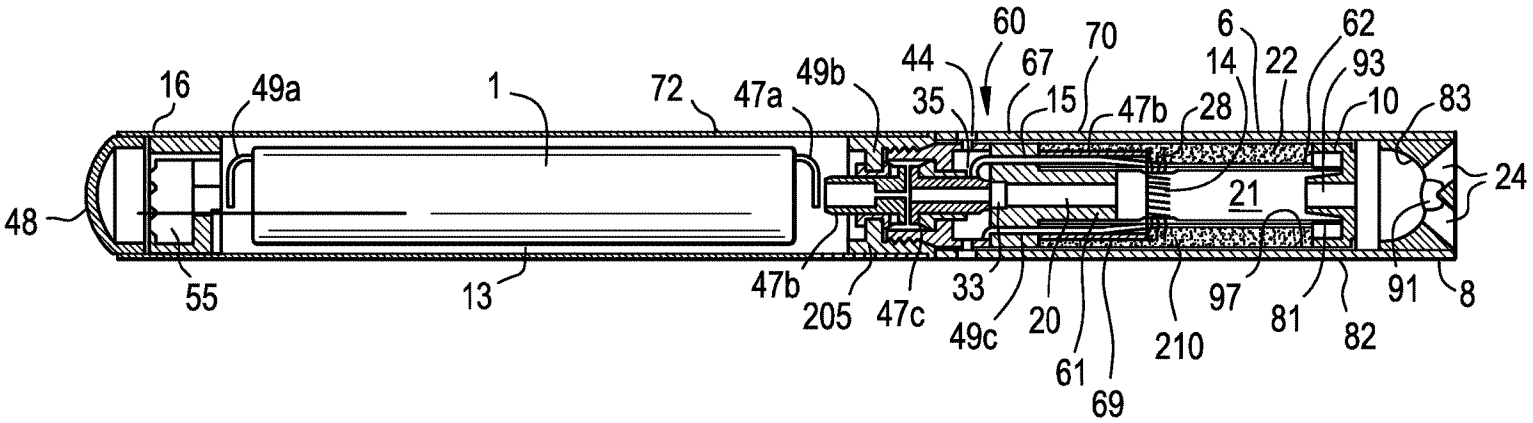
FIG. 2 is a side cross-sectional view of the e-vaping device shown in FIG. 1.

Referring to FIGS. 1 and 2, an e-vaping device 60 may include a replaceable cartridge (or first section) 70 and a reusable fixture (or second section) 72, which may be coupled together at a threaded connection 205. It should be appreciated that other convenience such as a snug-fit, detent, clamp, and/or clasp may be used to couple the first section 70 and the second section 72. The second section 72 may include a puff sensor 16 responsive to air drawn into the second section 72 via an air inlet port 45 adjacent a free end or tip of the e-vaping device 60, a battery 1, and a control circuitry. The first section 70 may include a liquid supply region 22 for a liquid and a heater 14 that may vaporize the liquid, which may be drawn from the liquid supply region 22 through a wick 28. Upon completing the threaded connection 205, the battery 1 may be electrically connectable with the heater 14 of the first section 70 upon actuation of the puff sensor 16. Air is drawn primarily into the first section 70 through one or more air inlets 44.

The first section 70 may include a mouth-end insert 8 having at least two diverging outlet passages 24 (e.g., preferably two to six outlet passages 24, more preferably 4 outlet passages 24). The outlet passages 24 may be located off-axis and may be angled outwardly in relation to a central channel 21 of an inner tube 62 (i.e., divergently). In an alternative embodiment, the mouth-end insert 8 may include outlet passages 24 uniformly distributed about the perimeter of the mouth-end insert 8 so as to substantially uniformly distribute aerosol in an adult vaper's mouth during use and create a greater perception of fullness in the mouth. Thus, as the vapor passes into the adult vaper's mouth, the vapor may enter the mouth and may move in different directions so as to provide a full mouth feel. In contrast, e-vaping devices having a single, on-axis orifice tend to direct its vapor as single jet of greater velocity toward a more limited location within an adult vaper's mouth.

In addition, the diverging outlet passages 24 may include interior surfaces 83 such that droplets of unvaporized liquid material, if any, may be entrained in the interior surfaces 83 of the mouth-end insert 8 and/or portions of walls which define the diverging outlet passages 24. As a result such droplets may be substantially removed or broken apart, so as to enhance the vapor.

In an example embodiment, the diverging outlet passages 24 may be angled at about 5° to about 60° with respect to the longitudinal axis of the outer tube 6 so as to more completely distribute vapor throughout a mouth of an adult vaper during use and to remove droplets. In yet another example embodiment, there may be four diverging outlet passages 24 each at an angle of about 40° to about 50° with respect to the longitudinal axis of the outer tube 6, more preferably about 40° to about 45° and most preferably about 42°. In yet another example embodiment, at the convergence of the diverging outlet passages 24 within the mouth-end insert 8, a hollow member 91 may be disposed therein.

In an example embodiment, each of the diverging outlet passages 24 may have a diameter ranging from about 0.015 inch to about 0.090 inch (e.g., about 0.020 inch to about 0.040 inch or about 0.028 inch to about 0.038 inch). The size of the diverging outlet passages 24 and the number of diverging outlet passages 24 can be selected to adjust the resistance-to-draw (RTD) of the electronic cigarette 60, if desired.

The first section 70 may include an outer tube (or casing) 6 extending in a longitudinal direction and an inner tube (or chimney) 62 coaxially positioned within the outer tube 6. At an upstream end portion of the inner tube 62, a nose portion 61 of a gasket (or seal) 15 may be fitted into the inner tube 62, while at the other end, an outer perimeter 67 of the gasket 15 may provide a liquid-tight seal with an interior surface of the outer casing 6. The gasket 15 may also include a central, longitudinal air passage 20, which opens into an interior of the inner tube 62 that defines a central channel. A transverse channel 33 at a backside portion of the gasket 15 may intersect and communicate with the central channel 20 of the gasket 15. This transverse channel 33 assures communication between the central channel 20 and a space 35 defined between the gasket 15 and a cathode connector piece 37 (as shown in FIG. 3).

Figure 3:
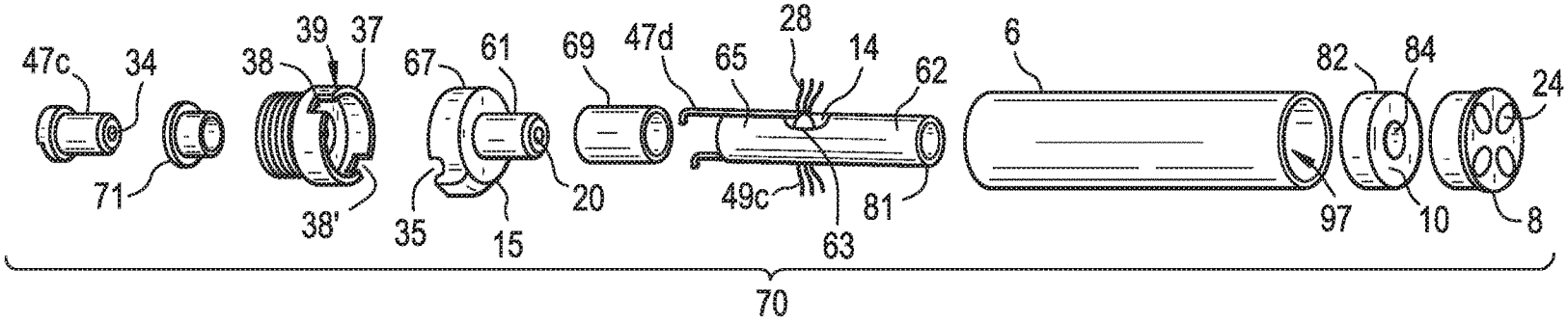
FIG. 3 is an exploded, perspective view of elements including a cartridge section of the e-vaping device shown in FIG. 1.

Referring to FIG. 3, the cathode connector piece 37 may include a threaded section for effecting the threaded connection 205. The cathode connector piece 37 may include opposing notches 38, 38' about its perimeter 39, which, upon insertion of the cathode connector piece 37 into the casing 6, may be aligned with the location of each of two resistance-to-draw (RTD) controlling, air inlet ports 44 in the outer tube 6. It should be appreciated that more than two air inlet ports 44 may be included in the outer tube 6. Alternatively, a single air inlet port 44 may be included in the outer tube 6. Such arrangement allows for placement of the air inlet ports 44 close to the threaded connection 205 without occlusion by the presence of the cathode connector piece 37. This arrangement may also reinforce the area of air inlet ports 44 to facilitate precise drilling of the air inlet ports 44.

Referring back to FIG. 1, in an example embodiment, at least one air inlet port 44 may be formed in the outer tube 6, adjacent the threaded connection 205 to minimize the chance of an adult vaper's fingers occluding one of the ports and to control the resistance-to-draw (RTD) during vaping. In an example embodiment, the air inlet ports 44 may be machined into the casing 6 with precision tooling such that their diameters are closely controlled and replicated from one e-vaping device 60 to the next during manufacture.

In a further example embodiment, the air inlet ports 44 may be drilled with carbide drill bits or other high-precision tools and/or techniques. In yet a further example embodiment, the outer tube 6 may be formed of metal or metal alloys such that the size and shape of the air inlet ports 44 may not be altered during manufacturing operations, packaging, and vaping. Thus, the air inlet ports 44 may provide consistent RTD. In yet a further example embodiment, the air inlet ports 44 may be sized and configured such that the electronic cigarette 60 has a RTD in the range of from about 60 mm $H_2O$ to about 150 mm $H_2O$, more preferably about 90 mm $H_2O$ to about 110 mm $H_2O$, most preferably about 100 mm $H_2O$ to about 130 mm $H_2O$.

During the RTD controlling, the air inlet ports 44 may be a critical orifice (i.e., the smallest orifice along the pathway from the air inlets 44 and the inner passage 21 of the inner tube 62 (where the heater 14 vaporizes liquid). Accordingly, the air inlet ports 44 may control the level of resistance to draw of the e-vaping device 60, which may be set at a level that contributes a drawing experience similar to that of a cigarette.

In another example embodiment, if another material is desired for the casing 6 (such as a plastic for presenting a softer feel), the air inlet ports 44 may be instead formed in a metallic plate fixture (or insert) 43 provided at the location of the air inlets 44 so as to maintain the precision of the air inlets 44.

Referring to FIG. 2, a nose portion 93 of a downstream gasket 10 may be fitted into a downstream end portion 81 of the inner tube 62. An outer perimeter 82 of the gasket 10 may provide a substantially liquid-tight seal with an interior surface 97 of the outer casing 6. The downstream gasket 10 may include a central channel 84 disposed between the central passage 21 of the inner tube 62 and the interior of the mouth-end insert 8, which may transport the vapor from the central passage 21 to the mouth-end insert 8.

The space defined between the gaskets 10 and 15 and the outer tube 6 and the inner tube 62 may establish the confines of a liquid supply region 22. The liquid supply region 22 may include a liquid material, and optionally a liquid storage medium 210 operable to store the liquid material therein. The liquid storage medium 210 may include a winding of cotton gauze or other fibrous material about the inner tube 62.

The liquid supply region 22 may be contained in an outer annulus between the inner tube 62 and the outer tube 6 and between the gaskets 10 and 15. Thus, the liquid supply region 22 may at least partially surround the central air passage 21. The heater 14 may extend transversely across the central channel 21 between opposing portions of the liquid supply region 22.

The liquid supply region 22 may be sized and configured to hold enough liquid material such that the e-vaping device 60 may be operable for vaping for at least about 200 seconds, preferably at least about 250 seconds, more preferably at least 300 seconds and most preferably at least about 350 seconds. Moreover, the e-vaping device 60 may be configured to allow each puff to last a maximum of about 5 seconds.

The liquid storage medium 210 may be a fibrous material including at least one of cotton, polyethylene, polyester, rayon and combinations thereof. The fibers may have a diameter ranging in size from about 6 microns to about 15 microns (e.g., about 8 microns to about 12 microns or about 9 microns to about 11 microns). The liquid storage medium 210 may be a sintered, porous or foamed material. Also, the fibers may be sized to be irrespirable and can have a cross-section which has a Y-shape, cross shape, clover shape or any other suitable shape. In an alternative embodiment, the liquid supply region 22 may include a filled tank lacking any fibrous storage medium 210 and containing only liquid material.

Figure 4:
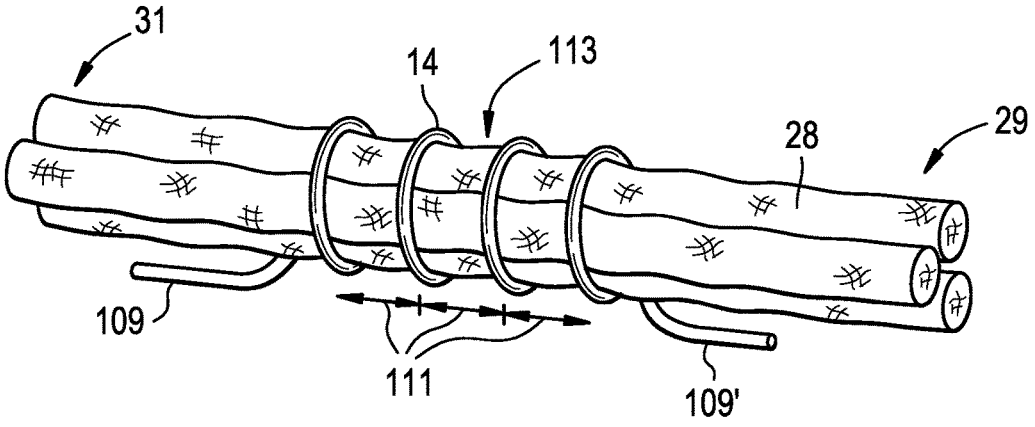
FIG. 4 is an enlarged detail view of a heater assembly of the e-vaping device shown in FIG. 1.

In use, liquid material may be transferred from the liquid supply region 22 and/or liquid storage medium 210 in the proximity of the heater 14 via capillary action of the wick 28. As shown in FIG. 4, the wick 28 may include a first end portion 29 and a second end portion 31. The first end portion 29 and the second end portion 31 may extend into opposite sides of the liquid storage medium 210 for contact with liquid material contained therein. More specifically, the wick 28 may extend through opposed slots 63 in the inner tube 62 such that each end of the wick 28 may be in contact with the liquid supply region 22. The heater 14 may at least partially surround a central portion 113 of the wick 28 such that when the heater 14 is activated, the liquid in the central portion 113 of the wick 28 may be vaporized by the heater 14 to form a vapor.

The wick 28 may include filaments (or threads) having a capacity to draw a liquid. For example, the wick 28 may be a bundle of glass (or ceramic) filaments, a bundle including a group of windings of glass filaments, etc., all of which arrangements may be capable of drawing liquid via capillary action by interstitial spacings between the filaments. The filaments may be generally aligned in a direction perpendicular (transverse) to the longitudinal direction of the e-vaping device 60. In an example embodiment, the wick 28 may include one to eight filament strands, preferably two to six filament strands, and most preferably three filament strands, each strand comprising a plurality of glass filaments twisted together. Moreover, it should be appreciated that the end portions of the 29 and 31 of the wick 28 may be flexible and foldable into the confines of the liquid supply region 22.

Furthermore, the wick 28 can include filaments having a cross-section which is generally cross-shaped, clover-shaped, Y-shaped or in any other suitable shape.

The wick 28 may include any suitable material or combination of materials. Examples of suitable materials may be, but not limited to, glass, ceramic- or graphite-based materials. Moreover, the wick 28 may have any suitable capillarity drawing action to accommodate vapor generating liquids having different liquid physical properties such as density, viscosity, surface tension and vapor pressure. The capillary properties of the wick 28, combined with the properties of the liquid, ensure that the wick 28 may always be wet in the area of the heater 14 so as to avoid overheating of the heater 14.

Referring to FIG. 4, the heater 14 may include a wire coil which at least partially surrounds the wick 28. The wire may be a metal wire and/or the heater coil may extend fully or partially along the length of the wick 28. The heater coil may further extend fully or partially around the circumference of the wick 28. It should be appreciated that the heater coil may or may not be in contact with the wick 28.

The heater coil may be formed of any suitable electrically resistive materials. Examples of suitable electrically resistive materials may include, but not limited to, titanium, zirconium, tantalum and metals from the platinum group. Examples of suitable metal alloys include, but not limited to, stainless steel, nickel, cobalt, chromium, aluminium-titanium-zirconium, hafnium, niobium, molybdenum, tantalum, tungsten, tin, gallium, manganese and iron-containing alloys, and super-alloys based on nickel, iron, cobalt, stainless steel. For example, the heater 14 can be formed of nickel aluminide, a material with a layer of alumina on the surface, iron aluminide and other composite materials, the electrically resistive material may optionally be embedded in, encapsulated or coated with an insulating material or vice-versa, depending on the kinetics of energy transfer and the external physicochemical properties required. The heater 14 may include at least one material selected from the group consisting of stainless steel, copper, copper alloys, nickel-chromium alloys, super alloys and combinations thereof. In an example embodiment, the heater 14 may be formed of nickel-chromium alloys or iron-chromium alloys. In another example embodiment, the heater 14 can be a ceramic heater having an electrically resistive layer on an outside surface thereof.

The heater 14 may heat liquid in the wick 28 by thermal conduction. Alternatively, heat from the heater 14 may be conducted to the liquid by means of a heat conductive element or the heater 14 may transfer heat to the incoming ambient air that is drawn through the e-vaping device 60 during use, which in turn heats the liquid by convection.

It should be appreciated that, instead of using a wick 28, the heater 14 can be a porous material which incorporates a resistance heater formed of a material having a high electrical resistance capable of generating heat quickly.

In another example embodiment, the wick 28 and the fibrous medium of the liquid supply region 22 may be constructed from fiberglass.

Referring back to FIG. 2, the power supply 1 may include a battery arranged in the e-vaping device 60 such that the anode 47*a* may be downstream of the cathode 49*a*. A battery anode post 47*b* of the second section 72 may contact the battery anode 47*a*. More specifically, electrical connection between the anode 47*a* of the battery 1 and the heater coil 14 in the first section 70 may be established through a battery anode connection post 47*b* in the second section 72 of the e-vaping device 60, an anode post 47*c* of the cartridge 70 and an electrical lead 47*d* connecting a rim portion of the anode post 47*c* with an electrical lead 109 of the heater element 14. Likewise, electrical connection between the cathode 49*a* of the battery 1 and the other lead 109' (shown in FIG. 4) of the heater coil 14 may be established through the threaded connection 205 between a cathode connection fixture 49*b* of the second portion 72 and the cathode connector piece 37 of the first section 70; and from there through an electrical lead 49*c* which electrically connects the fixture 37 to the opposite lead 109' of the heater coil 14.

The electrical leads 47*d*, 49*c* and the heater leads 109, 109' may be highly conductive and temperature resistant while the coiled section of the heater 14 is highly resistive so that heat generation occurs primarily along the coils of the heater 14. The electrical lead 47*d* may be connected to the heater lead 109 by crimping. Likewise, the electrical lead 49*c* may be connected to the heater lead 109' by crimping. In alternative embodiments, the electrical leads 47*d*, 49*c* can be attached to the heater leads 109, 109' via brazing, spot welding and/or soldering.

The power supply 1 may be a Lithium-ion battery or one of its variants, for example a Lithium-ion polymer battery. Alternatively, the power supply 1 may be a nickel-metal hydride battery, a nickel cadmium battery, a lithium-manganese battery, a lithium-cobalt battery or a fuel cell. In that case, preferably, the e-vaping device 60 may be usable by an adult vaper until the energy in the power supply 1 is depleted or in the case of lithium polymer battery, a minimum voltage cut-off level is achieved.

Further, the power supply 1 may be rechargeable and may include circuitry allowing the battery to be chargeable by an external charging device. In that case, the circuitry, when charged, provides power for a desired (or, alternatively, predetermined) number of puffs, after which the circuitry must be re-connected to an external charging device. To recharge the e-vaping device 60, an USB charger or other suitable charger assembly may be used.

Furthermore, the e-vaping device 60 may include a control circuit 55 including the puff sensor 16. The puff sensor 16 may be operable to sense an air pressure drop and initiate application of voltage from the power supply 1 to the heater 14. As shown in FIG. 2, the control circuit 55 can also include a heater activation light 48 operable to glow when the heater 14 is activated. The heater activation light 48 may include an LED and may be at an upstream end of the e-vaping device 60 so that the heater activation light 48 takes on the appearance of a burning coal during a puff. Moreover, the heater activation light 48 can be arranged to be visible to an adult vaper. In addition, the heater activation light 48 can be utilized for e-vaping system diagnostics or to indicate that recharging is in progress. The heater activation light 48 can also be configured such that the adult vaper can activate and/or deactivate the heater activation light 48 for privacy.

In addition, the at least one air inlet 45 may be located adjacent the puff sensor 16, such that the puff sensor 16 may sense air flow indicative of an adult vaper taking a puff and activates the power supply 1 and the heater activation light 48 to indicate that the heater 14 is working.

Further, the control circuit 55 may supply power to the heater 14 responsive to the puff sensor 16. In one embodiment, the control circuit 55 may include a maximum, time-period limiter. In another embodiment, the control circuit 55 may include a manually operable switch for an adult vaper to initiate a puff. The time-period of the electric current supply to the heater 14 may be pre-set depending on the amount of liquid desired to be vaporized. In another example embodiment, the circuitry 55 may supply power to the heater 14 as long as the puff sensor 16 detects a pressure drop.

When activated, the heater 14 may heat a portion of the wick 28 surrounded by the heater for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

Figure 5A:
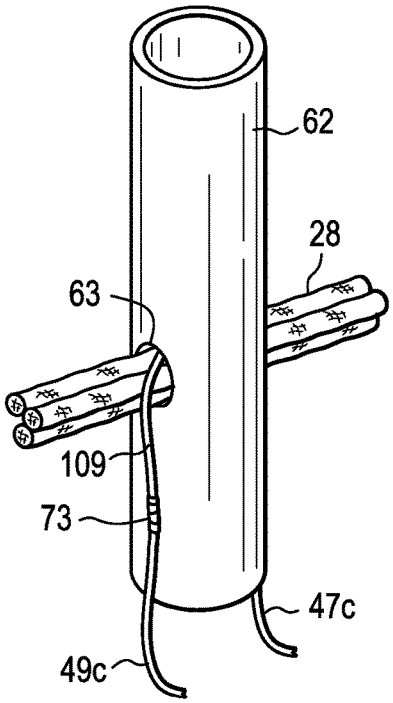
FIG. 5A is an enlarged view of an inner tube with a heater coil and wick assembly prior to positioning of a sleeve.

FIG. 5A is an enlarged view of the inner tube 62 with the heater coil 14 and the wick 28 prior to positioning of a sleeve.

Referring to FIG. 5A, the inner tube 62 may include a pair of opposing slots 63 such that the wick 28 and the leading end 109 (and 109') of the heater 14 may extend out from the respective opposing slots 63. The provision of the opposing slots 63 in the inner tube 62 may facilitate placement of the heater 14 and wick 28 into position within the inner tube 62 without impacting edges of the slots 63 and the coiled section of the heater 14. Accordingly, edges of the slots 63 may not be allowed to impact and alter the coil spacing 111 of the heater 14, which would otherwise create potential sources of hotspots.

Figure 5B:
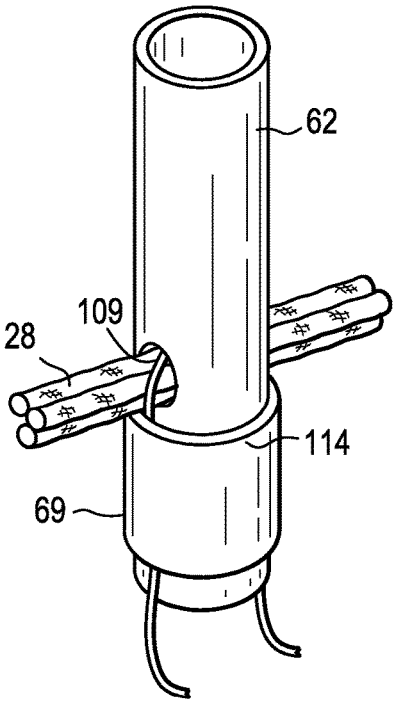
FIG. 5B is an enlarged view of the inner tube with a heater coil and wick assembly after positioning of a sleeve according to one example embodiment.

FIG. 5B is an enlarged view of the inner tube 62 with the heater coil 14 and the wick 28 after positioning of a sleeve 69 according to one example embodiment.

Referring to FIG. 5B, the sleeve 69 partially surrounds the inner tube 62. In other words, the sleeve 69 may be coaxial with the inner tube 62 and may be situated below the wick 28. The sleeve 69 may be proximate to or may touch, but does not urge against, the wick 28. Such positioning may avoid imposing bending moments upon the heater coil 14, and may avoid bowing of the heater coil 14, which might otherwise produce hotspots along one side of the heater coil 14 where the coil spacing 111 would become compressed and reduced. Thus, an upstream edge 114 of the sleeve 69 may be brought proximate of the wick 28, but is not positioned over the wick 28 so as to avoid the possibility of the aforementioned bowing effect. The sleeve 69, when placed as shown in FIG. 5B, may close off a remainder of open space provided between the heater coil assembly and the slot 63.

In addition, by placing the sleeve 69 below the wick 28, the sleeve 69 may cover the electrical connections between the leading end 109 (and 109') of the heater assembly and the electrical lead 47*c* (and 49*c*), which may be formed via crimping, for example, (referred as reference numeral 73 in FIG. 5A). As a result, this may avoid and/or reduce a reaction of the electrical connections, made from the electrically conductive material and heat resistance, with the liquid vapor formulation and fluid in the device. Further, this may reduce and/or prevent discoloration of the material of the liquid storage medium 210 and/or the wick 28 near the heating assembly.

Figure 5C:
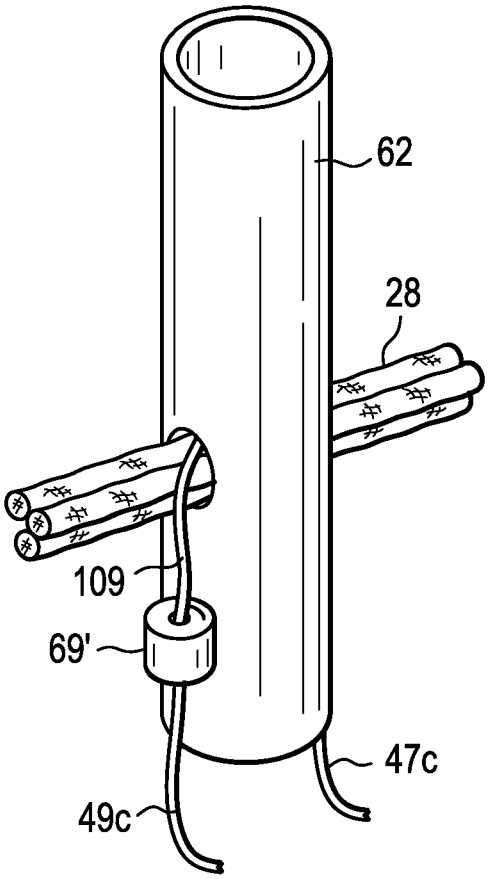
FIG. 5C is an enlarged view of the inner tube with a heater coil and wick assembly after positioning of a sleeve according to another example embodiment.

In an alternative embodiment, referring to FIG. 5C, a sleeve 69' may cover the connection between the leading end 109 of the heater assembly and the electrical lead 49*c*, which may be formed via crimping. In other words, instead of covering the inner tube 62 as shown in FIG. 5B, the sleeve 69' may cover only the connection between the leading end 109 and electrical lead 47*c*. It should be appreciated that another sleeve may be used to cover the connection between the leading end 109' and the electrical lead 47*c*.

In an example embodiment, the sleeve 69 (and 69') may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. In one embodiment, the material may be constructed from woven fiberglass.

In an example embodiment, the inner tube 62 may have a diameter of about 4 mm and each of the opposing slots 63 may have major and minor dimensions of about 2 mm by about 4 mm.

In an example embodiment, the first section 70 may be replaceable. In other words, once the liquid of the cartridge is spent, only the first section 70 may be replaced. An alternate arrangement may include an embodiment where the entire e-vaping device 60 may be disposed once the liquid supply is depleted.

In an example embodiment, the e-vaping device 60 may be about 80 mm to about 110 mm long, preferably about 80 mm to about 100 mm long and about 7 mm to about 8 mm in diameter. For example, in one example embodiment, the e-vaping device may be about 84 mm long and may have a diameter of about 7.8 mm.

It should further be appreciated that at least one adhesive-backed label may be applied to the outer tube 6. The label may completely circumscribe the e-vaping device 60 and can be colored and/or textured. The label may further include holes therein which are sized and positioned so as to prevent blocking of the air inlets 44.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A cartomizer, comprising:

a housing including an outer tube and an inner tube within the outer tube, the outer tube and the inner tube defining a fluid reservoir configured to store an e-fluid;

a vaporizer including a heater surrounding a wick, the heater having at least one end portion connected to an electrical lead wire via a connection within the fluid reservoir, the wick configured to draw the e-fluid from the fluid reservoir to the heater, the heater configured to vaporize the e-fluid; and at least one sleeve within the fluid reservoir and covering the connection, the at least one sleeve surrounding the connection such that a portion of the at least one sleeve is between the connection and the inner tube, the at least one sleeve disposed between the outer tube and the inner tube and without touching the wick, a diameter of the at least one sleeve being less than a diameter of the inner tube, the at least one sleeve configured to cover the connection so as to avoid or reduce a reaction between the connection and the e-fluid.

2. The cartomizer according to claim 1, wherein the connection between the at least one end portion of the heater and the electrical lead wire is formed by crimping.

3. The cartomizer according to claim 1, wherein the connection between the at least one end portion of the heater and the electrical lead wire is formed by soldering.

4. The cartomizer according to claim 1, wherein the connection between the at least one end portion of the heater and the electrical lead wire is formed by spot welding.

5. The cartomizer according to claim 1, wherein the inner tube includes a pair of opposing slots, and the at least one end portion of the heater extends through one of the pair of opposing slots.

6. The cartomizer according to claim 5, wherein the at least one sleeve is upstream from the pair of opposing slots of the inner tube relative to a flow of a vapor through the inner tube.

7. The cartomizer according to claim 5, wherein the e-fluid is a liquid material.

8. The cartomizer according to claim 1, wherein the at least one end portion of the heater is in a form of two end portions connected to two electrical lead wires via two connections; and the at least one sleeve is in a form of two sleeves covering the two connections between the two end portions of the heater and the two electrical lead wires.

9. An e-vaping device, comprising:

a cartomizer including, a housing including an outer tube and an inner tube within the outer tube, the outer tube and the inner tube defining a fluid reservoir configured to store an e-fluid, a vaporizer including a heater surrounding a wick, the heater having at least one end portion connected to an electrical lead wire via a connection within the fluid reservoir, the wick configured to draw the e-fluid from the fluid reservoir to the heater, the heater configured to vaporize the e-fluid, and at least one sleeve within the fluid reservoir and covering the connection, the at least one sleeve surrounding the connection such that a portion of the at least one sleeve is between the connection and the inner tube, the at least one sleeve disposed between the outer tube and the inner tube and without touching the wick, a diameter of the at least one sleeve being less than a diameter of the inner tube, the at least one sleeve configured to cover the connection so as to avoid or reduce a reaction between the connection and the e-fluid; and a power supply configured to supply power to the heater.

10. The e-vaping device according to claim 9, wherein the connection between the at least one end portion of the heater and the electrical lead wire is formed by crimping.

11. The e-vaping device according to claim 9, wherein the connection between the at least one end portion of the heater and the electrical lead wire is formed by soldering.

12. The e-vaping device according to claim 9, wherein the connection between the at least one end portion of the heater and the electrical lead wire is formed by spot welding.

13. The e-vaping device according to claim 9, wherein the inner tube includes a pair of opposing slots, and the at least one end portion of the heater extends through one of the pair of opposing slots.

14. The e-vaping device according to claim 13, wherein the e-fluid is a liquid material.

15. The e-vaping device according to claim 13, wherein the at least one end portion of the heater is in a form of two end portions connected to two electrical lead wires via two connections; and the at least one sleeve is in a form of two sleeves covering the two connections between the two end portions of the heater and the two electrical lead wires.

16. The e-vaping device according to claim 9, wherein the power supply is removably connected to the cartomizer via a connector.

* * * * *